US007793727B2

(12) United States Patent
Gaudette

(10) Patent No.: US 7,793,727 B2
(45) Date of Patent: Sep. 14, 2010

(54) LOW RATE GAS INJECTION SYSTEM

(75) Inventor: Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 176 days.

(21) Appl. No.: 12/203,541

(22) Filed: Sep. 3, 2008

(65) Prior Publication Data

US 2010/0051288 A1 Mar. 4, 2010

(51) Int. Cl.
*E21B 43/16* (2006.01)

(52) U.S. Cl. ..... 166/372; 166/68; 166/310

(58) Field of Classification Search ..... 166/372, 166/370, 310, 68
See application file for complete search history.

(56) References Cited

U.S. PATENT DOCUMENTS 3,941,510 A * 3/1976 Morgan ..... 417/57
5,211,242 A * 5/1993 Coleman et al. ..... 166/372
5,806,598 A * 9/1998 Amani ..... 166/372
6,021,849 A * 2/2000 Averhoff ..... 166/372
6,237,692 B1 * 5/2001 Averhoff ..... 166/372
6,354,377 B1 * 3/2002 Averhoff ..... 166/372
7,198,099 B2 * 4/2007 Lugtmeier et al. ..... 166/115
7,311,144 B2 * 12/2007 Conrad ..... 166/270.1
7,549,477 B2 * 6/2009 Khoshnevis ..... 166/372
2002/0040785 A1 * 4/2002 Amani ..... 166/373
2004/0123987 A1 * 7/2004 Reitz ..... 166/370
2006/0081378 A1 * 4/2006 Howard et al. ..... 166/372

* cited by examiner

*Primary Examiner*—Hoang Dang
(74) *Attorney, Agent, or Firm*—Shawn Hunter

(57) ABSTRACT

A dewatering device is provided that can be inserted concentrically within the production tubing string of a natural gas-producing wellbore. The dewatering device includes a pressure-isolating chamber that is provided with a fluid inlet valve and a fluid outlet valve and associated gas lift valves. Compressed gas and soap are used to form a foamy liquid mixture that is lifted out of the chamber.

17 Claims, 6 Drawing Sheets

LOW RATE GAS INJECTION SYSTEM

BACKGROUND OF THE INVENTION

1. Field of the Invention

The invention relates generally to devices and methods for removing water from a subterranean wellbore.

2. Description of the Related Art

The presence of water is natural gas wells is a significant hindrance to the production of gas. Water naturally migrates into a wellbore along with the natural gas. In the beginning of production, the gas flow rate is high enough that it carries the water to surface. As the well matures, the flow rate begins to drop. Eventually, water collects in the wellbore to the point where the production rate becomes very low. In some cases, the weight of the water increases pressure within the wellbore and prevents gas in the surrounding formation from entering the wellbore.

In the past, gas lift valves have been used to help lift the water out of the well. In these instances, a gas (such as compressed air) is injected into the gas lift valve from the surface to try to lift the water out of the well. This approach is problematic in that it is expensive and requires large supplies of compressed gases to maintain an acceptable flow rate of production from the well.

Prior art approaches to the removal of water from a natural gas well are discussed in U.S. Pat. Nos. 5,211,242; 5,501,279 and 6,629,566.

SUMMARY OF THE INVENTION

The invention provides methods and devices for removing water from a low rate production wellbore using gas injection. In preferred embodiments, a dewatering device is provided that can be inserted concentrically within the production tubing string of a natural gas-producing wellbore. The dewatering device includes a pressure-isolating chamber that is provided with a fluid inlet valve and a fluid outlet valve. The inlet and outlet valves are operably interconnected with a controller that controls when they are opened and closed. In a currently preferred embodiment, the controller controls the valves in accordance with a predetermined time period. In other embodiments, the controller is associated with a liquid level sensor, such as a float valve, which determines the level of liquid within the chamber. When a predetermined level of liquid is detected within the chamber, the valves are actuated.

The fluid outlet valve is interconnected with a fluid outlet line which extends to the surface of the wellbore. One or more supply lines for gas and soap (surfactant) extend from gas and soap supplies located on the surface to the chamber. In a preferred embodiment, flow of compressed gas and soap from the surface is continuous. The injected soap and compressed gas react with the water within the well to create a foamy liquid, which entraps the water.

Gas lift valves are incorporated within the gas supply line. A first gas lift valve is disposed within the pressure isolation chamber. A second gas lift valve is located above the chamber.

In exemplary operation, the dewatering device is disposed into a gas wellbore on a tool string through a production tubing string. The dewatering device is lowered to the point wherein the isolation chamber is disposed within the water in the wellbore. The fluid inlet valve is in the open position to permit water to enter the chamber. Thereafter, both the fluid inlet and fluid outlet valves are closed to isolate the volume of water. Compressed gas (e.g., air) and soap are flowed into the chamber. The compressed gas and soap mix with the water and create a pressurized liquid foam mixture. The fluid outlet valve is then opened to permit the liquid foam mixture to exit the chamber and enter the fluid outlet line. In preferred embodiments, a gas lift valve which is located above the chamber and within the fluid outlet line assists the liquid foam mixture to the surface.

In practice, the amount of compressed gases required to effectively remove water from the gas well, is significantly less than with many prior art approaches which largely require a high degree of compressed gas flow to propel a slug of liquid to the surface of the wellbore.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
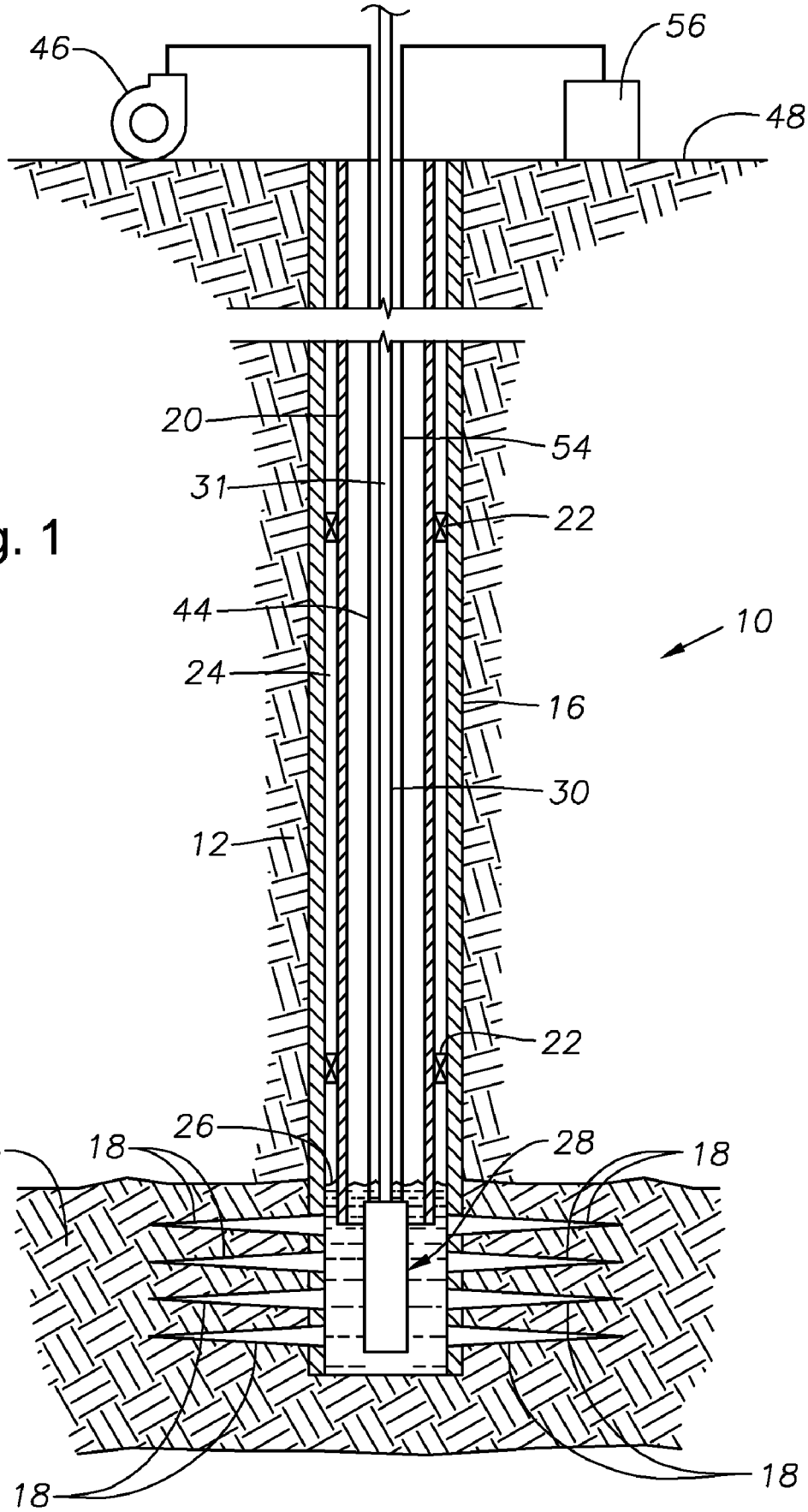
FIG. 1 is a side, cross-sectional view of an exemplary natural gas production wellbore containing production tubing and a dewatering system in accordance with the present invention.

FIG. 1 depicts an exemplary natural gas production wellbore 10 that has been drilled through the earth 12 down to a natural gas-bearing formation 14. The wellbore 10 has been lined with casing 16. Perforations 18 extend through the casing 16 and into the formation 14. A production tubing string 20 extends downwardly into the wellbore 10 and is set into place by one or more packers 22. An annulus 24 is defined between the production tubing string 20 and the casing 16. A collection of water 26 is located at the lower end of the wellbore 10.

Figure 2:
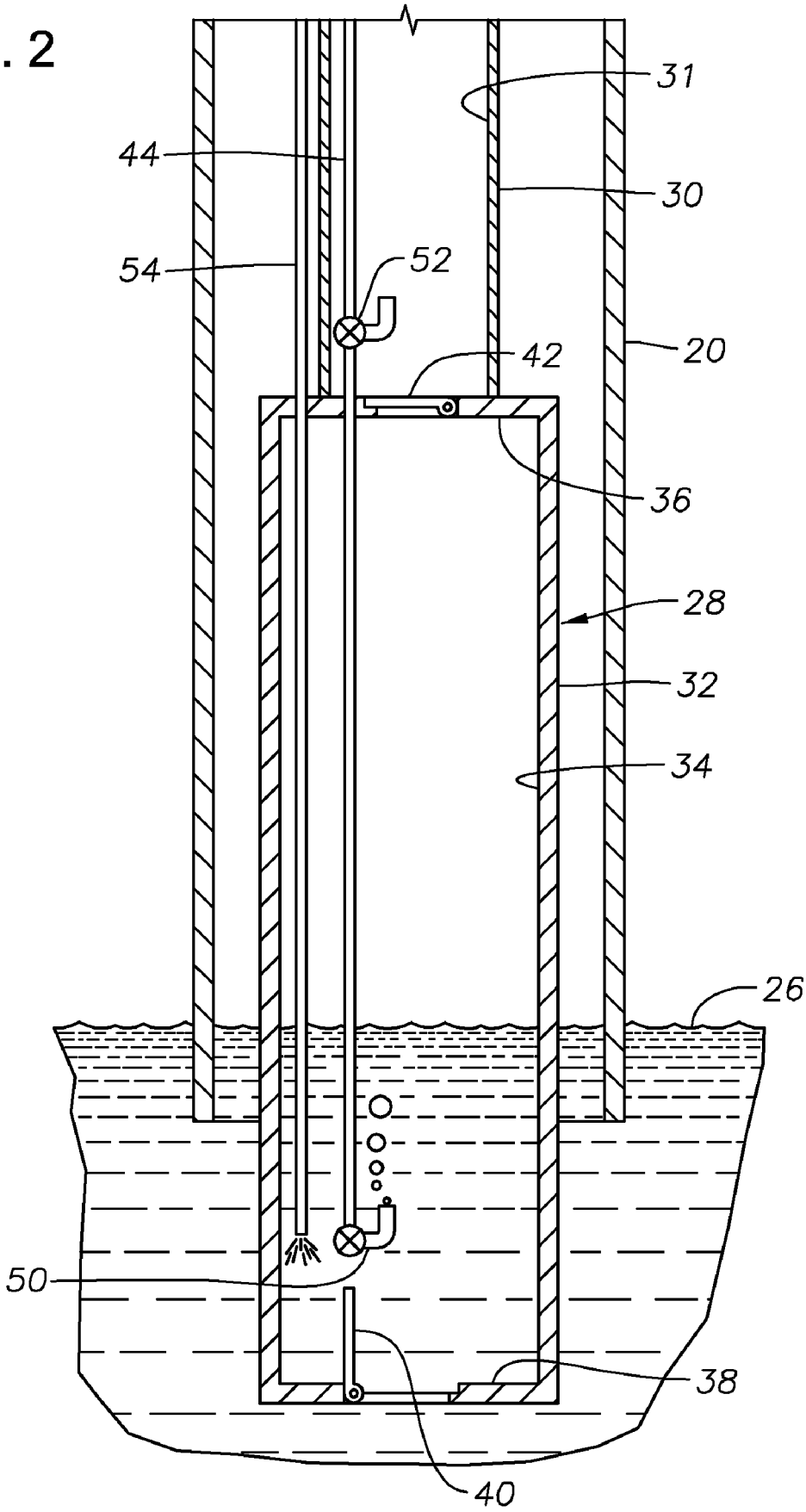
FIG. 2 is a side, cross-sectional view of an exemplary dewatering device constructed in accordance with the present invention, in a configuration to be filled with water within the wellbore.

A dewatering device, generally indicated at 28, is disposed within the production tubing string 20 on a tool string 30. The tool string 30 preferably comprises a string of coiled tubing or the like, of a type known in the art. A water removal conduit 31 is defined within the tool string 30. FIG. 2 depicts the dewatering device 28 in greater detail. The dewatering device 28 generally includes a housing 32 that defines a pressure-isolation chamber 34 having an upper axial end 36 and a lower axial end 38. The lower axial end 38 has a fluid inlet valve 40, and the upper axial end 36 has a fluid outlet valve 42. In FIG. 2, the fluid inlet and outlet valves 40,42 are depicted schematically. However, it is currently preferred that both valves 40, 42 are spool valves, of a type known in the art. However, flapper-type valves, ball valves and other valves of a type known in the art may be used. Each of the valves 40, 42 is operable between an open position, wherein fluid may pass through the valve, and a closed position, wherein fluid flow through the valve is blocked.

A compressed gas supply line 44 extends from a gas supply 46 at the surface 48 and into the chamber 34. The gas supply line 44 includes a first gas lift valve 50, which is located inside of the chamber 34 and a second gas lift valve 52, which is located above the chamber 34 and within the tool string 30. In addition, a soap supply line 54 extends from a soap supply 56 at the surface 48 downwardly through the production tubing string 24 and into the chamber 34 of the housing 32. The soap supply may be any of a number of commercially available surfactants, such as F.O.A.M. products, which are available commercially from the Baker Petrolite Division of Baker Hughes Incorporated of Houston, Tex. The type and formulation of soap that is used will depend upon the composition of production fluids found in the wellbore 10. During typical operation of the dewatering device 28, soap is continuously pumped down the soap supply line 54. In addition, compressed gas is continuously pumped down the gas supply line 44.

Figure 5:
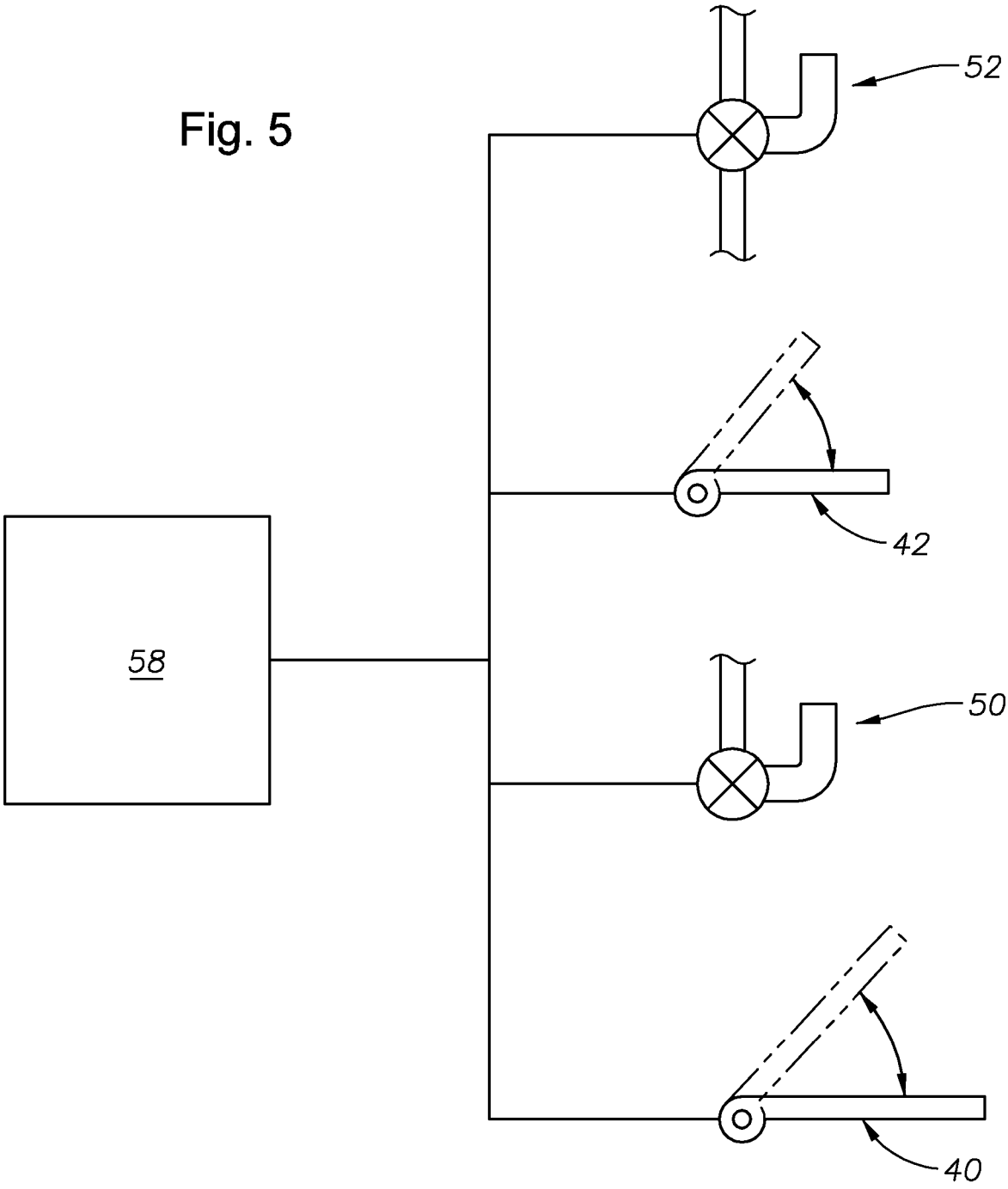
FIG. 5 is a schematic view depicting the interconnection of a controller with the gas lift valves used in associated with the dewatering device shown in FIGS. 2-4.

FIG. 5 schematically illustrates that a controller 58 is operably interconnected with the first and second gas lift valves 50, 52 as well as the inlet and outlet valves 40, 42. The controller 58 may comprise a programmable processor or other logic circuitry, of a type known in the art, which can control each of the valves 40, 42, 50, 52 in accordance with a preprogrammed or predetermined scheme. In one embodiment, the controller includes a timer which operates the valves 40, 42, 50, 52 according to predetermined time intervals. Exemplary operation of the controller 58 will be best understood in conjunction with a discussion of the overall operation of the dewatering device 28 which follows. The controller 58 may be located at the surface 48 or within the wellbore 10. Communication between the controller 58 and the valves 40, 42, 50, 52 may be by means of physical electrical wiring or by wireless communication. Alternatively, their may be hydraulic communication between the controller 58 and the valves 40, 42, 50, 52 or any combination of the above.

In exemplary operation, the dewatering device 28 is assembled with the tool string 20 and both are disposed into the production tubing string 20. The tool string 30 is lowered though the production tubing string 20 until the housing 32 of the dewatering device is disposed in the water 26, as depicted in FIGS. 1 and 2. During run-in, the fluid inlet valve 40 is in an open position, and the fluid outlet valve 42 is closed, as depicted in FIG. 2. Water 26 enters the chamber 34 of the housing 32. At this time, the controller 58 controls the second gas lift valve 52 to be closed, and the first gas lift valve 50 to be open to permit compressed gas to flow into the chamber 34. Soap also flows into the chamber 34 via the soap supply line 54.

Figure 3:
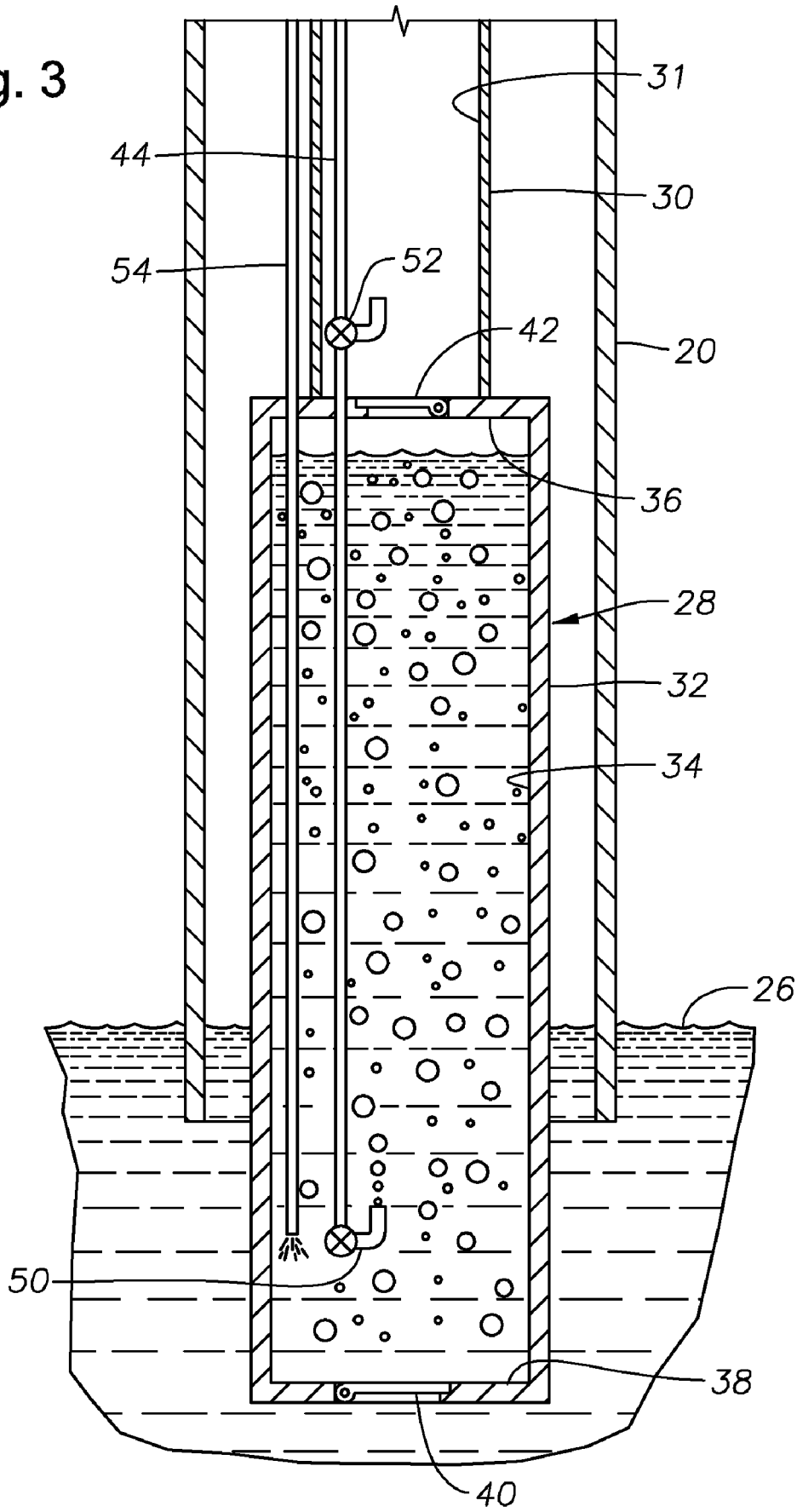
FIG. 3 is a side, cross-sectional view of the dewatering device shown in FIG. 2, now in a configuration for pressurizing the chamber of the dewatering device.

The controller 58 then closes the fluid inlet valve 40, so that the dewatering device 28 is in the configuration shown in FIG. 3. Fluid pressure builds within the chamber 34, and the water 26 within the chamber 34 mixes with the soap entering the chamber 34. The compressed gas entering through the gas lift valve 50 agitates the water and soap mixture to create a foamy liquid having a reduced density as compared to liquid water. The water within the chamber 34 becomes entrapped within the foamy mixture.

Figure 4:
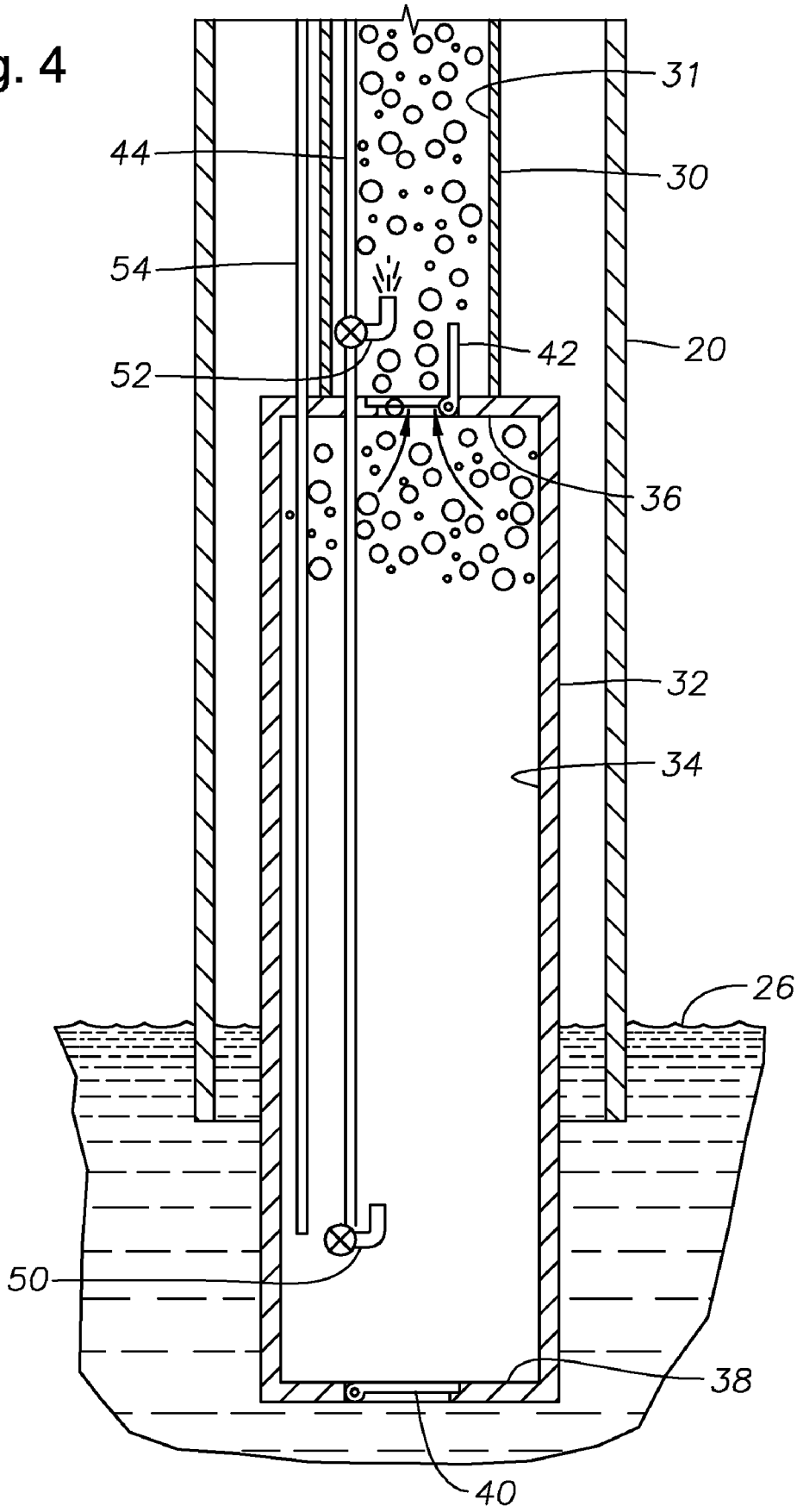
FIG. 4 is a side, cross-sectional view of the dewatering device shown in FIGS. 2-3, now in a configuration for lifting water and foam to the surface.

In the next step of operation the fluid outlet valve 42 is opened by the controller 58, as shown in FIG. 4. The release of pressure within the chamber 34 will cause the foamy mixture to move upwardly into the tool string 30. At substantially the same time that the fluid outlet valve 42 is opened, the controller 58 opens the gas lift valve 52. Flow of gas into the tool string 30 will help to lift the foamy mixture toward the surface 48.

The operation can then be repeated to flow additional water-bearing mixture toward the surface 48. The controller 58 will return the dewatering device to the configuration depicted in FIG. 2 by reopening the fluid inlet valve 40 and closing the fluid outlet valve 42. The second gas lift valve 52 is closed and the first gas lift valve 50 is opened. Additional water 26 will enter the chamber 34, and the process can be repeated to send an additional amount of water 26 toward the surface.

In the instance where flapper valves are used for the inlet and outlet valves 40,42, there would be no need for the controller 58 to control their operation. In that case, operation of the flapper valves would occur as a result of differential pressures caused by operation of the gas lift valves 50, 52.

In practice, the devices and method of the present invention provide a significant cost savings. The use of compressed gas in conjunction with soap to form a foamy mixture which entraps the water requires less compressed gas to move the water to the surface than merely using compressed gas by itself.

Figure 6:
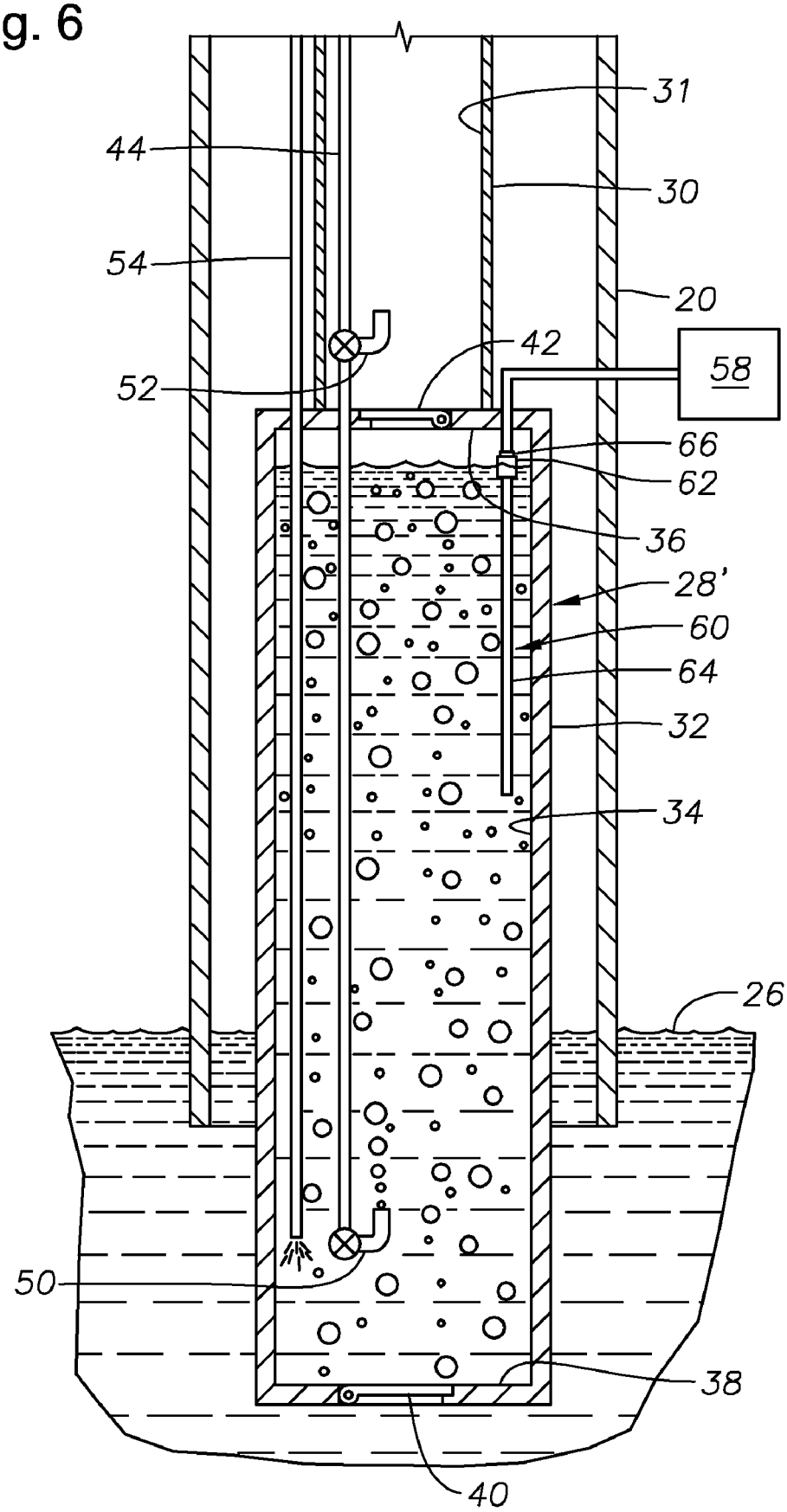
FIG. 6 is a side, cross-sectional view of an alternative embodiment of a dewatering device which incorporates a liquid level sensor.

In an alternative embodiment, depicted in FIG. 6, the dewatering device 28' includes a liquid level sensor for determining the level of water 26 within the chamber 34. In the depicted embodiment, the liquid level sensor is in the form of a float valve 60 within the chamber 34. The float valve 60 includes a float 62 that is moveably disposed on a rod 64. As water 26 fills the chamber 34, the float 62 rises on the rod 64 until it contacts a sensor 66, which is operably interconnected with the controller 58. Upon contact between the float 62 and the sensor 66, a signal is provided to the controller 58, indicating that the chamber 34 is filled. Thereafter, the controller 58 closes the inlet valve 40 and opens the outlet valve 42. At the same time, the controller 58 closes the first gas lift valve 50 and opens the second gas lift valve 52 to lift the foamy liquid mixture out of the chamber 34 and upwardly through the tool string 30. Other liquid level sensor arrangements known in the art may be used as well in place of the depicted float valve 60.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A dewatering device for removing water from a natural gas well, the device comprising:

a housing defining a chamber with a fluid inlet valve and a fluid outlet valve;

the fluid inlet valve being operable between an open position, wherein water within the natural gas well can enter the chamber, and a closed position wherein water is blocked from entering the chamber;

the fluid outlet valve being in communication with a water removal conduit and being operable between a closed position, wherein fluid within the chamber cannot be communicated from the chamber to the water removal conduit, and an open position wherein fluid within the chamber can be communicated from the chamber to the water removal conduit;

a soap supply operably interconnected with the housing to deliver soap into the chamber to intermix with water entering the chamber through the fluid inlet valve; and a gas supply operably interconnected with the housing to deliver a compressed gas into the chamber and agitate the soap and water into a foamy liquid mixture; and a controller operably interconnected with the fluid inlet valve and fluid outlet valve to operate the inlet and outlet valves between the open and closed positions.

2. The dewatering device of claim 1 further comprising a gas lift valve located within the chamber and operably associated with the gas supply for delivery of gas within the chamber, the gas lift valve being operable between open and closed positions.

3. The dewatering device of claim 1 further comprising a gas lift valve located within a water removal conduit proximate the fluid outlet valve, the gas lift valve being operable between open and closed positions.

4. The dewatering device of claim 3 wherein the gas lift valve is located outside of the chamber.

5. The dewatering device of claim 1 further comprising:

a first gas lift valve located within the chamber and operably associated with the gas supply for delivery of gas within the chamber, the gas lift valve being operable between open and closed positions; and a second gas lift valve located within a water removal conduit proximate the fluid outlet valve, the gas lift valve being operable between open and closed positions.

6. The dewatering device of claim 5 further comprising a controller operably interconnected with the first and second gas lift valve to operate the gas lift valves in accordance with a predetermined scheme.

7. The dewatering device of claim 1 further comprising a liquid level sensor operable to determine the level of liquid within the chamber and being operably interconnected with the controller to provide a signal representative of said level of liquid to the controller.

8. The dewatering device of claim 7 wherein the liquid level sensor comprises a float valve.

9. A system for removing water from a natural gas well, the system comprising:

a housing interconnected with a tool string which defines a water removal conduit, the housing defining a chamber with a fluid inlet valve and a fluid outlet valve;

the fluid inlet valve being operable between an open position, wherein water within the natural gas well can enter the chamber, and a closed position, wherein water is blocked from entering the chamber;

the fluid outlet valve being in communication with the water removal conduit and being operable between a closed position, wherein fluid within the chamber cannot be communicated from the chamber to the water removal conduit, and an open position, wherein fluid within the chamber can be communicated from the chamber to the water removal conduit;

a soap supply operably interconnected with the housing to deliver soap into the chamber to intermix with water entering the chamber through the fluid inlet valve;

a gas supply operably interconnected with the housing to deliver a compressed gas into the chamber and agitate the soap and water into a foamy liquid mixture;

a first gas lift valve located within the chamber and operably associated with the gas supply for delivery of gas within the chamber, the gas lift valve being operable between open and closed positions to selectively agitate fluid within the chamber; and a second gas lift valve located within a water removal conduit proximate the fluid outlet valve and operably associated with the gas supply for delivery of gas outside of the chamber, the gas lift valve being operable between open and closed positions to selectively flow agitated fluid through the water removal conduit away from the chamber.

10. The system of claim 9 further comprising a soap supply operably interconnected with the housing to deliver soap into the chamber to intermix with water entering the chamber through the fluid inlet valve.

11. The system of claim 9 further comprising a controller operably interconnected with the first and second gas lift valve to operate the gas lift valve to operate the gas lift valves in accordance with a predetermined scheme.

12. The system of claim 9 further comprising a controller operably interconnected with the fluid inlet valve and fluid outlet valve to operate the valves in accordance with a predetermined scheme.

13. A method for removing water from a natural gas well comprising the steps of:

disposing a dewatering device into the well on a tool string having' a water removal conduit, the dewatering device comprising:

a housing defining a pressure-isolation chamber; and a fluid outlet valve operable between open and closed positions to selectively flow fluid from the chamber to the water removal conduit;

flowing water from the well into the chamber;

flowing soap into the chamber to mix with the water to form a foamy mixture;

opening the fluid outlet valve to flow the foamy mixture into the water removal conduit; and flowing a compressed gas into the water removal conduit after opening the fluid outlet valve to help flow the foamy mixture along the water removal conduit.

14. The method of claim 13 further comprising the step of flowing a compressed gas into the chamber to mix the water and soap into a foamy mixture.

15. A dewatering device for removing water from a natural gas well, the device comprising:

a housing defining a chamber with a fluid inlet valve and a fluid outlet valve;

the fluid inlet valve being operable between an open position, wherein water within the natural gas well can enter the chamber, and a closed position, wherein water is blocked from entering the chamber;

the fluid outlet valve being in communication with a water removal conduit and being operable between a closed position, wherein fluid within the chamber cannot be communication from the chamber to the water removal conduit, and an open position, wherein fluid within the chamber can be communicated from the chamber to the water removal conduit;

a first gas lift valve located within the chamber for delivery of gas within the chamber to agitate water within the chamber; and a second gas lift valve located within the water removal conduit, the second gas lift valve being operable to move agitated water through the water removal conduit away from the chamber.

16. The dewatering device of claim 15 further comprising a soap supply operably interconnected with the housing to deliver soap into the chamber to intermix with water entering the chamber through the fluid inlet valve.

17. The dewatering device of claim 15 wherein the second gas lift valve is operated to move agitated water through the water removal conduit when the fluid outlet valve is opened.

* * * * *